US009653789B2

(12) United States Patent
Wolf et al.

(10) Patent No.: US 9,653,789 B2
(45) Date of Patent: May 16, 2017

(54) ANTENNA HAVING PLANAR CONDUCTING ELEMENTS, ONE OF WHICH HAS A SLOT

(75) Inventors: Forrest D. Wolf, Reno, NV (US); Claude Jean Michel Laurent, Aalborg (DK)

(73) Assignee: AirWire Technologies, Reno, NV (US)

( * ) Notice: Subject to any disclaimer, the term of this patent is extended or adjusted under 35 U.S.C. 154(b) by 1236 days.

(21) Appl. No.: 12/755,294

(22) Filed: Apr. 6, 2010

(65) Prior Publication Data

US 2011/0241944 A1 Oct. 6, 2011

(51) Int. Cl.

| | |
|---|---|
| ***H01Q 1/24*** | (2006.01) |
| ***H01Q 1/38*** | (2006.01) |
| ***H01Q 9/28*** | (2006.01) |
| ***H01Q 5/20*** | (2015.01) |

(52) U.S. Cl.

CPC ..... *H01Q 1/38* (2013.01); *H01Q 1/243* (2013.01); *H01Q 5/20* (2015.01); *H01Q 9/285* (2013.01)

(58) Field of Classification Search

CPC ..... H01Q 1/38; H01Q 9/285; H01Q 1/243; H01Q 5/001; H01Q 5/20

USPC ..... 343/700 MS, 702, 795, 829, 846

See application file for complete search history.

(56) References Cited

U.S. PATENT DOCUMENTS 4,825,220 A * 4/1989 Edward ..... H01Q 9/285 343/700 MS
5,532,708 A * 7/1996 Krenz ..... H01Q 9/40 343/795
6,018,324 A 1/2000 Kitchener
6,624,793 B1 9/2003 Su et al.
6,806,842 B2 * 10/2004 King ..... B65D 5/4233 340/572.8
6,956,536 B2 * 10/2005 Lee ..... H01Q 1/38 343/700 MS
7,095,374 B2 * 8/2006 Chen ..... G06F 1/1616 343/700 MS (Continued)

FOREIGN PATENT DOCUMENTS

CN 2735559 Y 10/2005
WO 2008079066 A1 7/2008

OTHER PUBLICATIONS

Jeon et al. "Dual-band slot-coupled dipole antenna for 900MHz and 2.45 GHz RFID tag application" IEEE Electronic Letters, vol. 42, No. 22, pp. 1259-1260, Oct. 26, 2006.*

(Continued)

*Primary Examiner* — Tho G. Phan

(57) ABSTRACT

An antenna includes a dielectric material having a first side opposite a second side, and a conductive via therein. A first planar conducting element is on the first side of the dielectric material and has at least one closed slot therein, and an electrical connection to the conductive via. A second planar conducting element is on the first side of the dielectric material. Each of the first and second planar conducting elements is positioned adjacent a gap that electrically isolates the first planar conducting element from the second planar conducting element. An electrical microstrip feed line is on the second side of the dielectric material, is electrically connected to the conductive via, and has a route extending from the conductive via, to across the gap, to under the second planar conducting element. The second planar conducting element provides a reference plane for the electrical microstrip feed line.

23 Claims, 7 Drawing Sheets

(56) References Cited

U.S. PATENT DOCUMENTS

| | | | | |
|---|---|---|---|---|
| 7,176,843 | B2 * | 2/2007 | Shimasaki | H01Q 1/38 343/700 MS |
| 7,339,529 | B2 * | 3/2008 | Martek | H01Q 1/241 343/700 MS |
| 7,548,214 | B2 | 6/2009 | Chou et al. | |
| 7,684,781 | B2 * | 3/2010 | Saito et al. | 455/333 |
| 2003/0231139 | A1 | 12/2003 | Tai et al. | |
| 2005/0035919 | A1 * | 2/2005 | Yang et al. | 343/795 |
| 2006/0208956 | A1 | 9/2006 | Surducan et al. | |
| 2007/0069970 | A1 * | 3/2007 | Argaman | H01Q 15/162 343/840 |
| 2007/0103369 | A1 * | 5/2007 | Ratni et al. | 343/700 MS |
| 2008/0198084 | A1 | 8/2008 | Yeap | |
| 2008/0303722 | A1 * | 12/2008 | Feltz et al. | 343/700 MS |
| 2010/0149751 | A1 * | 6/2010 | Camacho et al. | 361/679.55 |

OTHER PUBLICATIONS

Katsuta, Mizuho, et al., "Planar Trapezoid Dipole Antenna Having Band Notch at 5GHz and Multi Band for 2 GHz WLAN and UWB," 2007 IEEE Antennas and Propagation Society International Symposium, Jun. 9-15, 2007, Honolulu, HI USA, pp. 641-644.

International Search Report and Written Opinion dated Aug. 2, 2011 for international application No. PCT/US2011/031422, 9 PP.

Supplementary European Search Report and Written Opinion dated May 14, 2014 for European Application No. 11766657.8. 6 pages.

* cited by examiner

ANTENNA HAVING PLANAR CONDUCTING ELEMENTS, ONE OF WHICH HAS A SLOT

BACKGROUND

A dipole antenna is a useful antenna for receiving or transmitting radio frequency radiation. However, a dipole antenna operates in only one frequency band, and antennas that operate in multiple bands are sometimes needed. For example, an antenna that operates in multiple bands is often needed for Worldwide Interoperability for Microwave Access (WiMAX), Ultra Wideband (UWB), Wireless Fidelity (Wi-Fi), ZigBee and Long Term Evolution (LTE) applications.

SUMMARY

In one embodiment, an antenna comprises a dielectric material having i) a first side opposite a second side, and ii) a conductive via therein. A first planar conducting element is on the first side of the dielectric material and has i) at least one closed slot therein, ii) an electrical connection to the conductive via, and iii) dimensions that cause it to resonate over a first range of frequencies centered about a first center frequency. A second planar conducting element is also on the first side of the dielectric material. Each of the first and second planar conducting elements is positioned adjacent a gap that electrically isolates the first planar conducting element from the second planar conducting element. The second planar conducting element has dimensions that cause it to resonate over a second range of frequencies centered about a second center frequency. An electrical microstrip feed line is on the second side of the dielectric material. The electrical microstrip feed line is electrically connected to the conductive via and has a route that extends from the conductive via, to across the gap, to under the second planar conducting element. The second planar conducting element provides a reference plane for the electrical microstrip feed line.

In another embodiment, an antenna comprises a dielectric material having i) a first side opposite a second side, and ii) a conductive via therein. A first planar conducting element is on the first side of the dielectric material. The first planar conducting element has i) at least one closed slot therein, and ii) an electrical connection to the conductive via. A second planar conducting element is on the first side of the dielectric material. Each of the first and second planar conducting elements is positioned adjacent a gap that electrically isolates the first planar conducting element from the second planar conducting element. An electrical microstrip feed line is on the second side of the dielectric material. The electrical microstrip feed line is electrically connected to the conductive via and has a route that extends from the conductive via, to across the gap, to under the second planar conducting element. The second planar conducting element provides a reference plane for the electrical microstrip feed line.

Other embodiments are also disclosed.

BRIEF DESCRIPTION OF THE DRAWINGS

Illustrative embodiments of the invention are illustrated in the drawings, in which.

In the drawings, like reference numbers in different figures are used to indicate the existence of like (or similar) elements in different figures.

DETAILED DESCRIPTION

Figure 1:
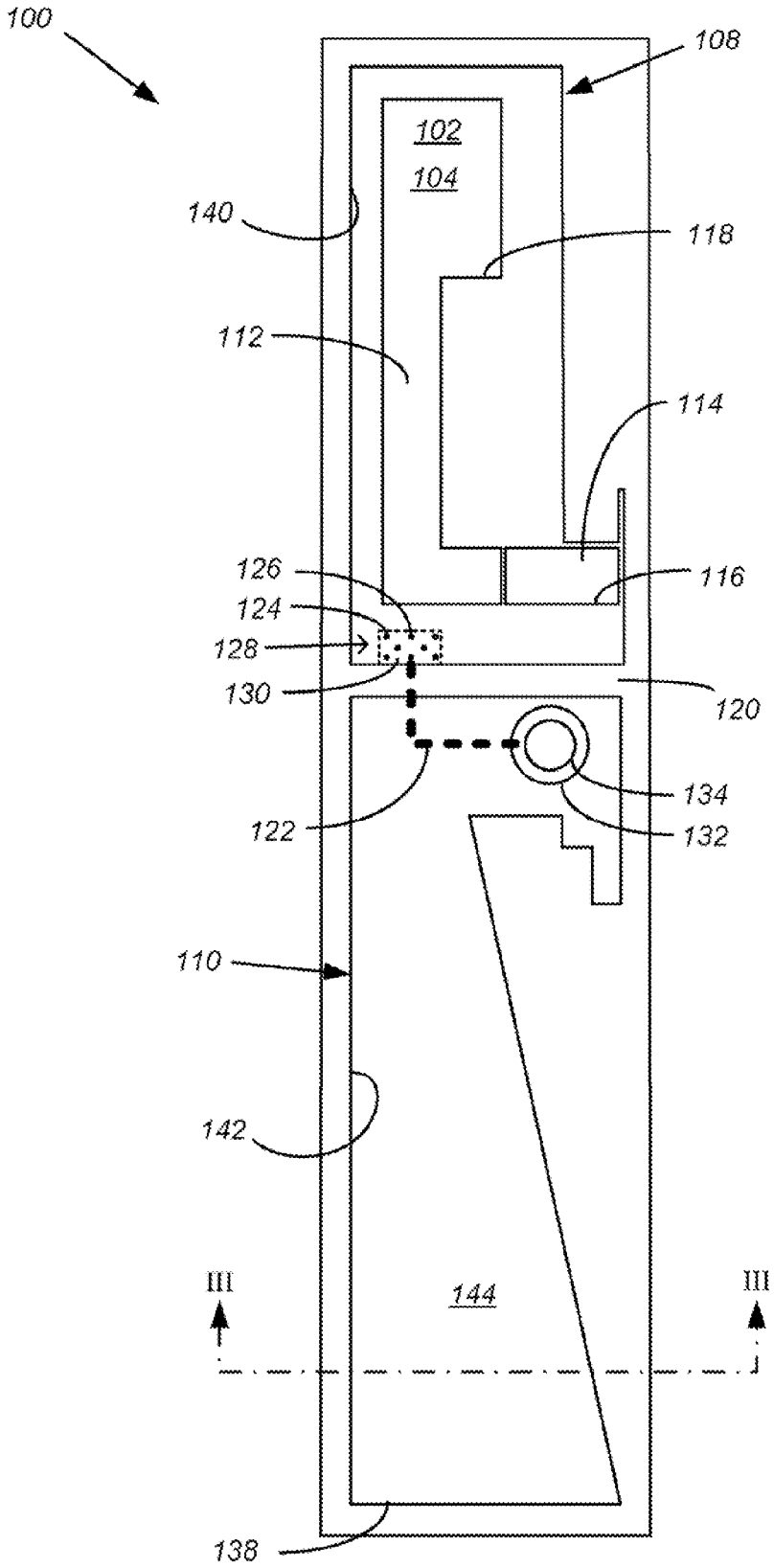
FIGS. 1-3 illustrate a first exemplary embodiment of an antenna having first and second planar conducting elements, one of which comprises a slot and is electrically connected to an electrical microstrip feed line.
Figure 2:
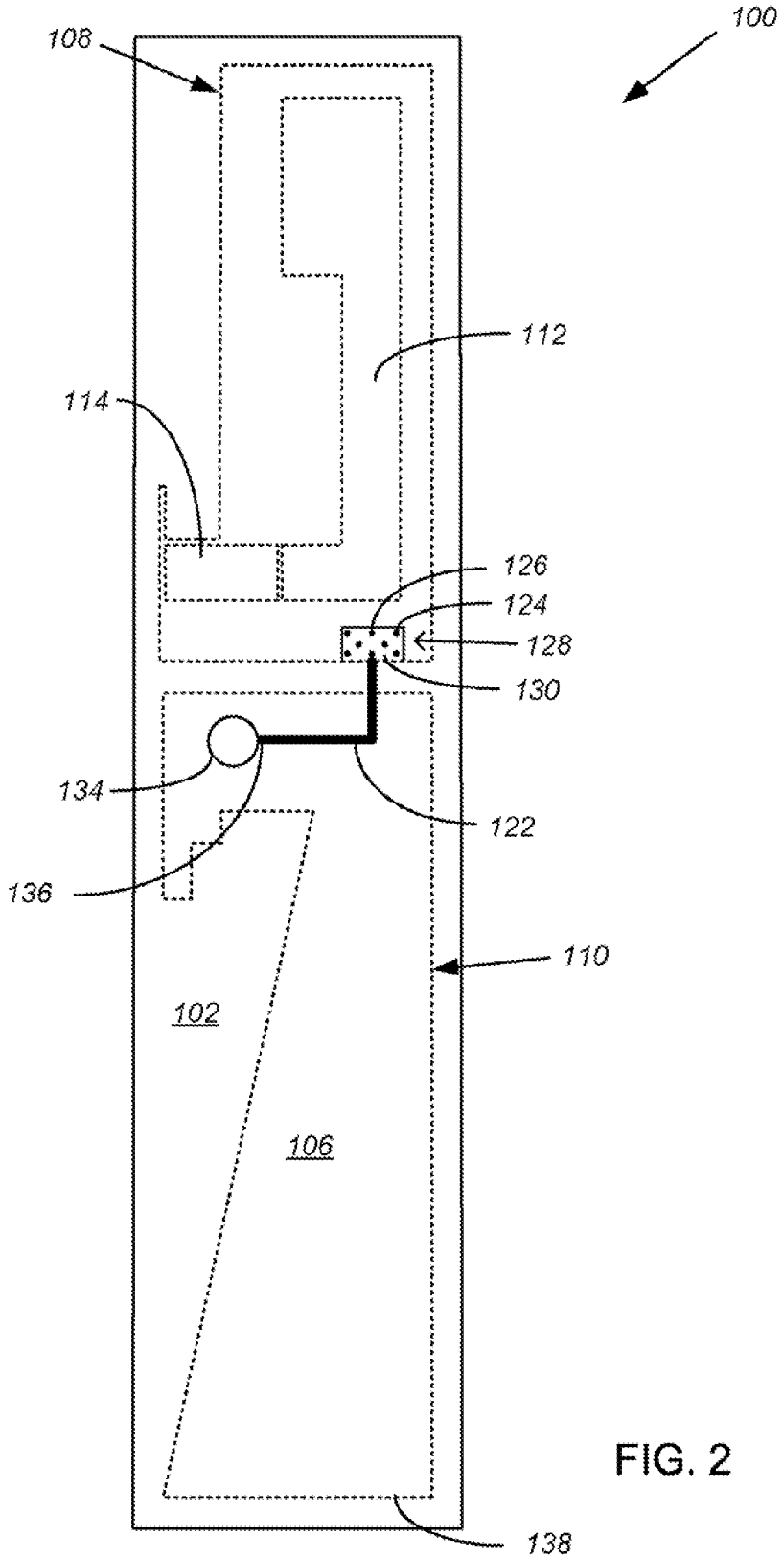
Figure 3:
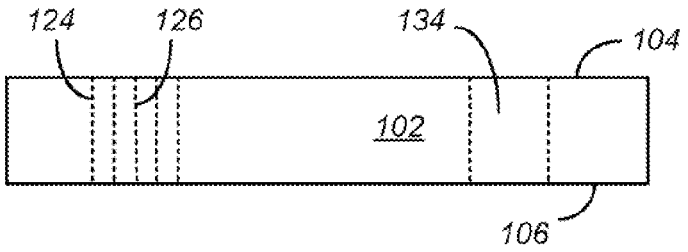

FIGS. 1-3 illustrate a first exemplary embodiment of an antenna 100. The antenna 100 comprises a dielectric material 102 having a first side 104 and a second side 106 (see FIG. 3). The second side 106 is opposite the first side 104. By way of example, the dielectric material 102 may be formed of (or may comprise) FR4, plastic, glass, ceramic, or composite materials such as those containing silica or hydrocarbon. The thickness of the dielectric material 102 may vary, but in some embodiments is equal to (or about equal to) 0.060" (1.524 millimeters).

First and second planar conducting elements 108, 110 (FIG. 1) are disposed on the first side 104 of the dielectric material 102. The first planar conducting element 108 has a pair of slots 112, 114 therein. A first of the slots 114 has a rectangular slot perimeter 116. A second of the slots 112 has a slot perimeter 118 having more than four edges (and can be thought of as a slot defined by a plurality of overlapping, rectangular slot segments). Each of the first and second planar conducting elements 108, 110 is positioned adjacent a gap 120 that electrically isolates the first planar conducting element 108 from the second planar conducting element 110. By way of example, each of the first and second conducting elements 108, 110 may be metallic and formed of (or may comprise) copper, aluminum or gold. In some cases, the first and second conducting elements 108, 110 may be printed or otherwise formed on the dielectric material 102 using, for example, printed circuit board construction techniques; or, the first and second conducting elements 108, 110 may be attached to the dielectric material 102 using, for example, an adhesive.

An electrical microstrip feed line 122 (FIG. 2) is disposed on the second side 106 of the dielectric material 102. By way of example, the electrical microstrip feed line 122 may be printed or otherwise formed on the dielectric material 102 using, for example, printed circuit board construction techniques; or, the electrical microstrip feed line may be attached to the dielectric material 102 using, for example, an adhesive.

The dielectric material 102 has a plurality of conductive vias (e.g., vias 124, 126) therein, with each of the conductive vias 124, 126 being positioned proximate others of the conductive vias at a connection site 128. The first planar conducting element 108 and the electrical microstrip feed line 122 are each electrically connected to the plurality of conductive vias 124, 126, and are thereby electrically connected to one another. By way of example, the first planar conducting element 110 is electrically connected directly to the plurality of conductive vias 124, 126, whereas the electrical microstrip feed line 122 is electrically connected to the plurality of conductive vias 124, 126 by a rectangular conductive pad 130 that connects the electrical microstrip feed line 122 to the plurality of conductive vias 124, 126.

As best shown in FIG. 2, the electrical microstrip feed line 122 has a route that extends from the plurality of conductive vias 124, 126, to across the gap 120 (that is, the route crosses the gap 120), to under the second planar conducting element 110. In this manner, the second planar conducting element 110 provides a reference plane for the electrical microstrip feed line 122.

The first planar conducting element 108 has dimensions that cause it to resonate over a first range of frequencies centered about a first center frequency. The second planar conducting element 110 has dimensions that cause it to resonate over a second range of frequencies centered about a second center frequency. At least some of the frequencies in the second range of frequencies differ from at least some of the frequencies in the first range of frequencies. In this manner, and during operation, the first and second planar conducting elements 108, 110 are capable of receiving different frequency signals and energizing the electrical microstrip feed line 122 in response to the received signals (in receive mode). In a similar fashion, a radio connected to the electrical microstrip feed line 122 may energize the first planar conducting element 108, the second planar conducting element 110, or both, depending on the frequency (or frequencies) at which the radio operates in transmit mode.

As shown in FIGS. 1 & 2, the second planar conducting element 110 has a hole 132 therein. The dielectric material 102 has a hole 134 therein. By way of example, the holes 132, 134 are shown to be concentric and round. The hole 132 in the second planar conducting element 110 is larger than the hole 134 in the dielectric material 102, thereby exposing the first side 104 of the dielectric material 102 in an area adjacent the hole 134 in the dielectric material 102.

Figure 4:
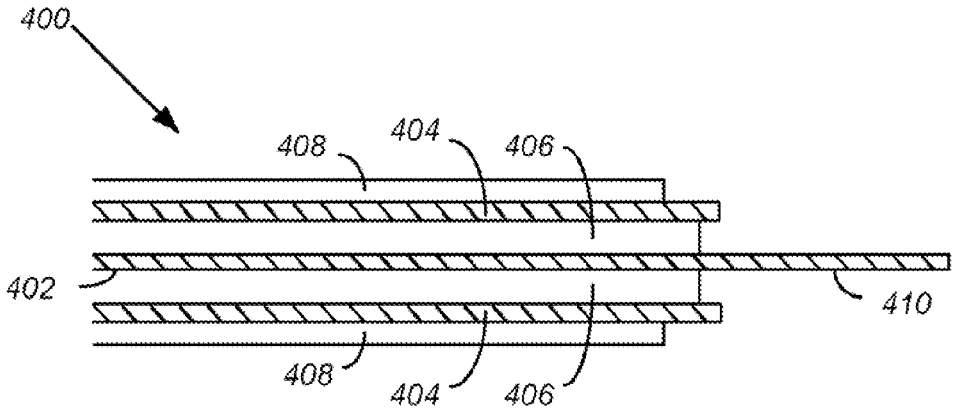
FIG. 4 illustrates a portion of an exemplary coax cable that may be electrically connected to the antenna shown in FIGS. 1-3.
Figure 7:
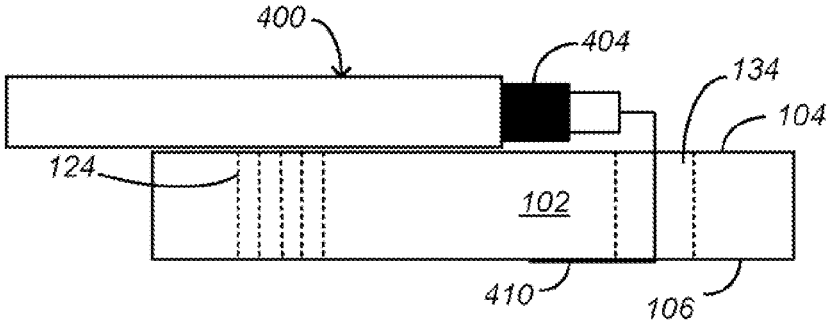
FIGS. 5-7 illustrate an exemplary connection of the coax cable shown in FIG. 4 to the antenna shown in FIGS. 1-3.
Figure 5:
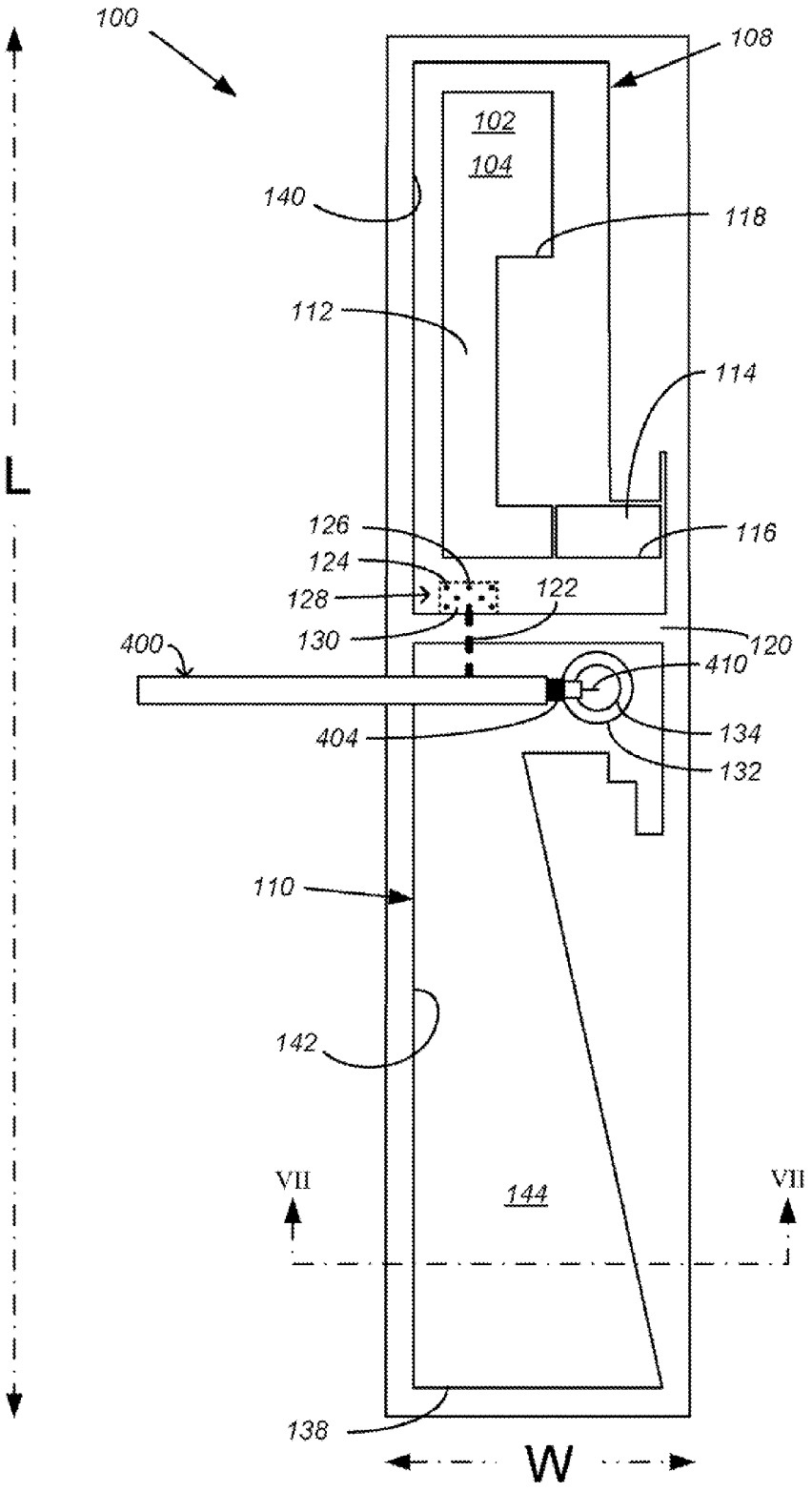
Figure 6:
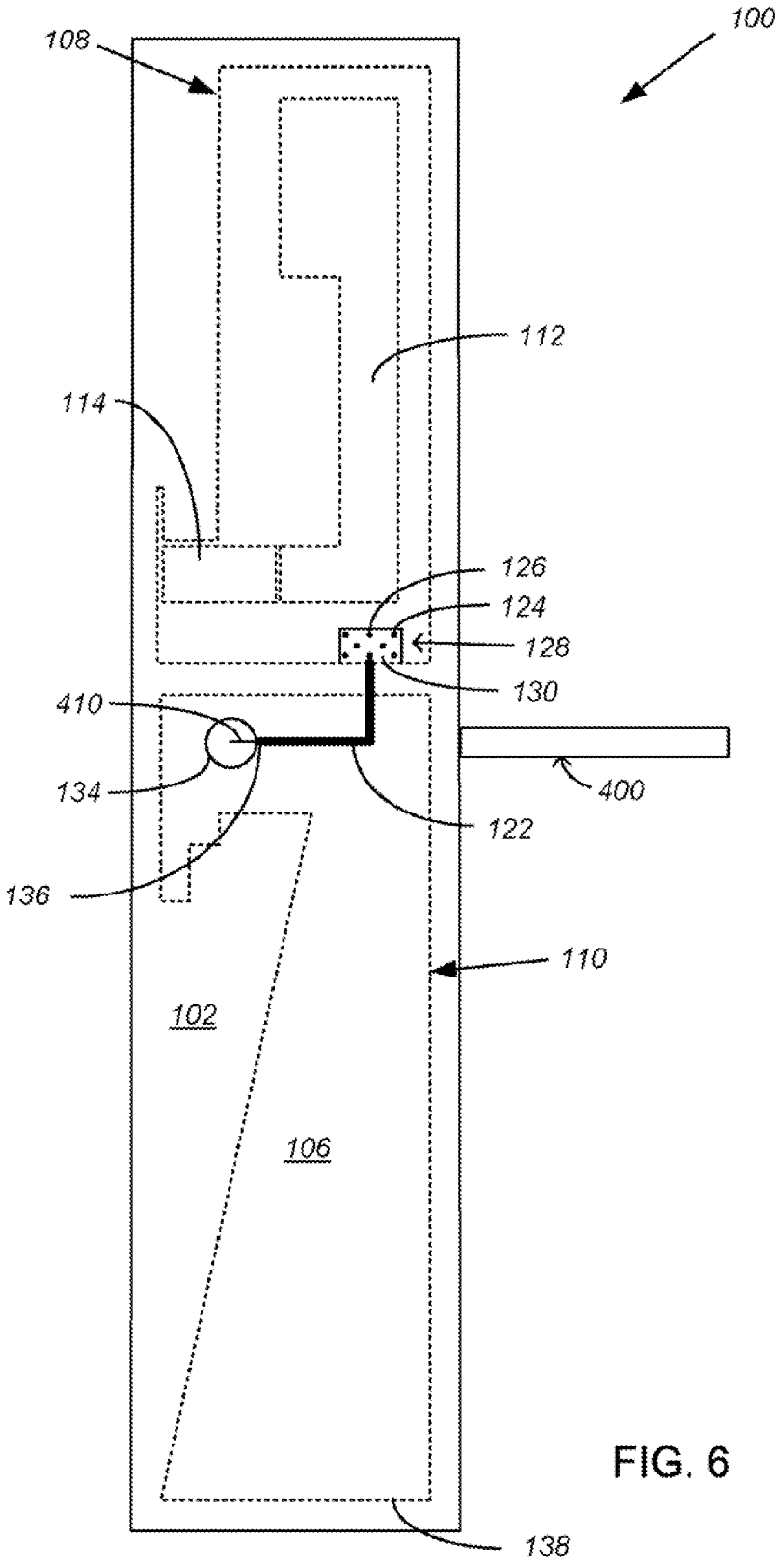

FIG. 4 illustrates a portion of an exemplary coax cable 400 that may be attached to the antenna 100 as shown in FIGS. 5-7. The coax cable 400 (FIG. 4) has a center conductor 402, a conductive sheath 404, and a dielectric 406 that separates the center conductor 402 from the conductive sheath 404. The coax cable 400 may also comprise an outer dielectric jacket 408. A portion 410 of the center conductor 402 extends from the conductive sheath 404 and the dielectric 406. The coax cable 400 is electrically connected to the antenna 100 by positioning the coax cable 400 adjacent the first side 104 of the antenna 100 and inserting the portion 410 of its center conductor 402 through the holes 132, 134 (see FIGS. 5 & 7). The center conductor 402 is then electrically connected to the electrical microstrip feed line 122 by, for example, soldering, brazing or conductively bonding the portion 410 of the center conductor 402 to the electrical microstrip feed line 122 (see FIGS. 6 & 7). The conductive sheath 404 of the coax cable 400 is electrically connected to the second planar conducting element 110 (also, for example, by way of soldering, brazing or conductively bonding the conductive sheath 404 to the second planar conducting element 110; see FIGS. 5 & 7). The exposed ring of dielectric material 102 adjacent the hole 134 in the dielectric material 102 can be useful in that it prevents the center conductor 402 of the coax cable 400 from shorting to the conductive shield 404 of the coax cable 400. In some embodiments, the coax cable 400 may be a 50 Ohm (Ω) coax cable.

The antenna 100 has a length, L, extending from the first planar conducting element 112 to the second planar conducting element 114. The length, L, crosses the gap 120. The antenna 100 has a width, W, that is perpendicular to the length. The coax cable 400 follows a route that is parallel to the width of the antenna 100. The coax cable 400 is urged along the route by the electrical connection of its conductive sheath 404 to the second planar conducting element 110, or by the electrical connection of its center conductor 402 to the electrical microstrip feed line 122.

In the antenna shown in FIGS. 1-3 & 5-7, the route of the electrical microstrip feed line 122 changes direction under the second planar conducting element 114. More specifically, the route of the electrical microstrip feed line 122 crosses the gap 120 parallel to the length of the antenna 100, then changes direction and extends parallel to the width of the antenna 100. The electrical microstrip feed line 122 may generally extend from the plurality of conductive vias 124, 126 to a termination point 136 adjacent the hole 134 in the dielectric material 102.

As previously mentioned, the first planar conducting element 108 has dimensions that cause it to resonate over a first range of frequencies centered about a first center frequency. The center frequency and bandwidth of the first range of frequencies can be configured by adjusting the size and shape of either (or both of) the perimeter 140 of the first planar conducting element 108 or (and) the perimeters 116, 118 of the slots 112, 114. Although the perimeters 140, 116, 118 of the first planar conducting element 108 and its slots 112, 114 are shown to have a plurality of straight edges, some or all of the edges may alternately be curved, or one or more of the perimeters 140, 116, 118 may have a shape with a continuous curve. The center frequency and bandwidth of the first range of frequencies can also be configured by adjusting the positions and relationships of the slots 112, 114 with respect to each other, or with respect to the first planar conducting element 108.

As also previously mentioned, the second planar conducting element 110 has dimensions that cause it to resonate over a second range of frequencies centered about a second center frequency. The center frequency and bandwidth of the second range of frequencies can be configured by adjusting the size and shape of the perimeter 142 of the second planar conducting element 110. Although the perimeter 142 of the second planar conducting element 110 is shown to have a plurality of straight edges, some or all of the edges may alternately be curved, or the perimeter 142 of the second planar conducting element 110 may have a shape with a continuous curve. As shown in FIGS. 1 & 5, a portion 144 of the second planar conducting element 110 may have a horn shape.

An advantage of the antenna 100 shown in FIGS. 1-3 & 5-7 is that the antenna 100 operates in multiple bands, and with an omni-directional azimuth, small size and high gain. By way of example, the antenna 100 shown in FIGS. 1-3 & 5-7 has been constructed in a form factor having a width of about 7 millimeters (7 mm) and a length of about 38 mm. In such a form factor, and with the first and second planar conducting elements 108, 110 configured as shown in FIGS. 1-3 & 5-7, the first planar conducting element 108 has been configured to resonate in a first range of frequencies extending from about 3.3 Gigahertz (GHz) to 3.8 GHz, and the second planar conducting element 110 has been configured to resonate in a second range of frequencies extending from about 2.3 GHz to 2.7 GHz. Such an antenna is therefore capable of operating as a WiMAX or LTE antenna, resonating at or about the commonly used center frequencies of 2.3 GHz, 2.5 GHz and 3.5 GHz.

The antenna 100 shown in FIGS. 1-3 & 5-7 may be modified in various ways for various purposes. For example, the perimeters 140, 142 of the first and second planar conducting elements 108, 110 may take alternate forms, such as forms having: more or fewer edges than shown in FIGS. 1, 2, 5 & 6; straight or curved edges; or continuously curved perimeters. The perimeters 116, 118 of the slots 112, 114 in the first planar conducting element 108 may also take alternate forms, such as forms having: more or fewer edges than shown in FIGS. 1, 2, 5 & 6; straight or curved edges; or continuously curved perimeters. In some embodiments, the shape of either or both of the planar conducting elements 108, 110, the shape of part of a planar conducting element 108, 110, or the shape of an included slot 112, 114, may be defined by one or more interconnected rectangular conducting segments or slot segments. In some embodiments, the first planar conducting element 108 may be modified to have more or fewer slots. In other (or the same) embodiments, the second planar conducting element 110 may be modified to include one or more slots.

For the antenna 100 shown in FIGS. 1-6, the dimensions of the first and second planar conducting elements 108, 110 cause the first and second conducting elements 108, 110 to resonate over non-overlapping frequency ranges. However, in some embodiments, the first and second conducting elements could be sized and shaped so that they resonate over overlapping frequency ranges.

In some embodiments, the holes 132, 134 in the second planar conducting element 110 and dielectric material 102 may be sized, positioned and aligned as shown in FIGS. 1, 2, 5 & 6. In other embodiments, the holes 132, 134 may be sized, positioned or aligned in different ways. As defined herein, "aligned" holes are holes that at least partially overlap, so that an object may be inserted through the aligned holes. Though FIG. 1 illustrates holes 132, 134 that are sized and aligned such that the first side 104 of the dielectric material 102 is exposed adjacent the hole 134 in the dielectric material 102, the first side 104 of the dielectric material 102 need not be exposed adjacent the hole 134.

In some embodiments, the plurality of conductive vias 124, 126 shown in FIGS. 1, 2, 5 & 6 may comprise more or fewer vias; and in some cases, the plurality of conductive vias 124, 126 may consist of only one conductive via. Despite the number of conductive vias 124, 126 provided at a connection site 128, the rectangular conductive pad 130 may be replaced by a conductive pad having another shape; or, one or more conductive vias 124, 126 may be electrically connected directly to the electrical microstrip feed line 122 (i.e., without use of the pad 130).

In FIGS. 1, 2, 5 & 6, and by way of example, the gap 120 between the first and second planar conducting elements 108, 110 is shown to be rectangular and of uniform width.

The operating bands of an antenna that is constructed as described herein may be contiguous or non-contiguous. In some cases, each operating band may cover part or all of a standard operating band, or multiple standard operating bands. However, it is noted that increasing the range of an operating band can in some cases narrow the gain of the operating band.

Figure 8:
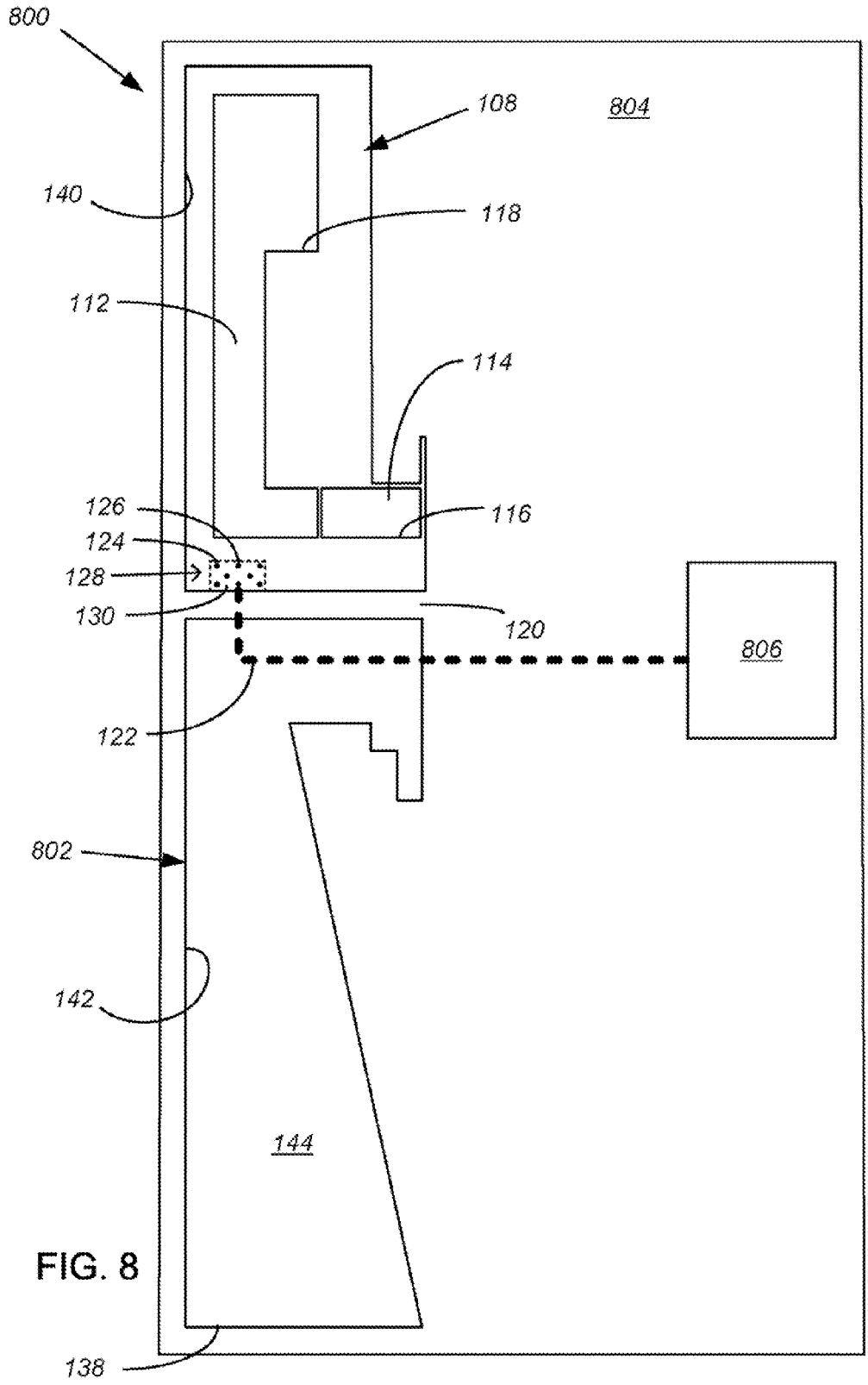
FIGS. 8 & 9 illustrate a second exemplary embodiment of an antenna having first and second planar conducting elements, one of which comprises a slot and is electrically connected to an electrical microstrip feed line.
Figure 9:
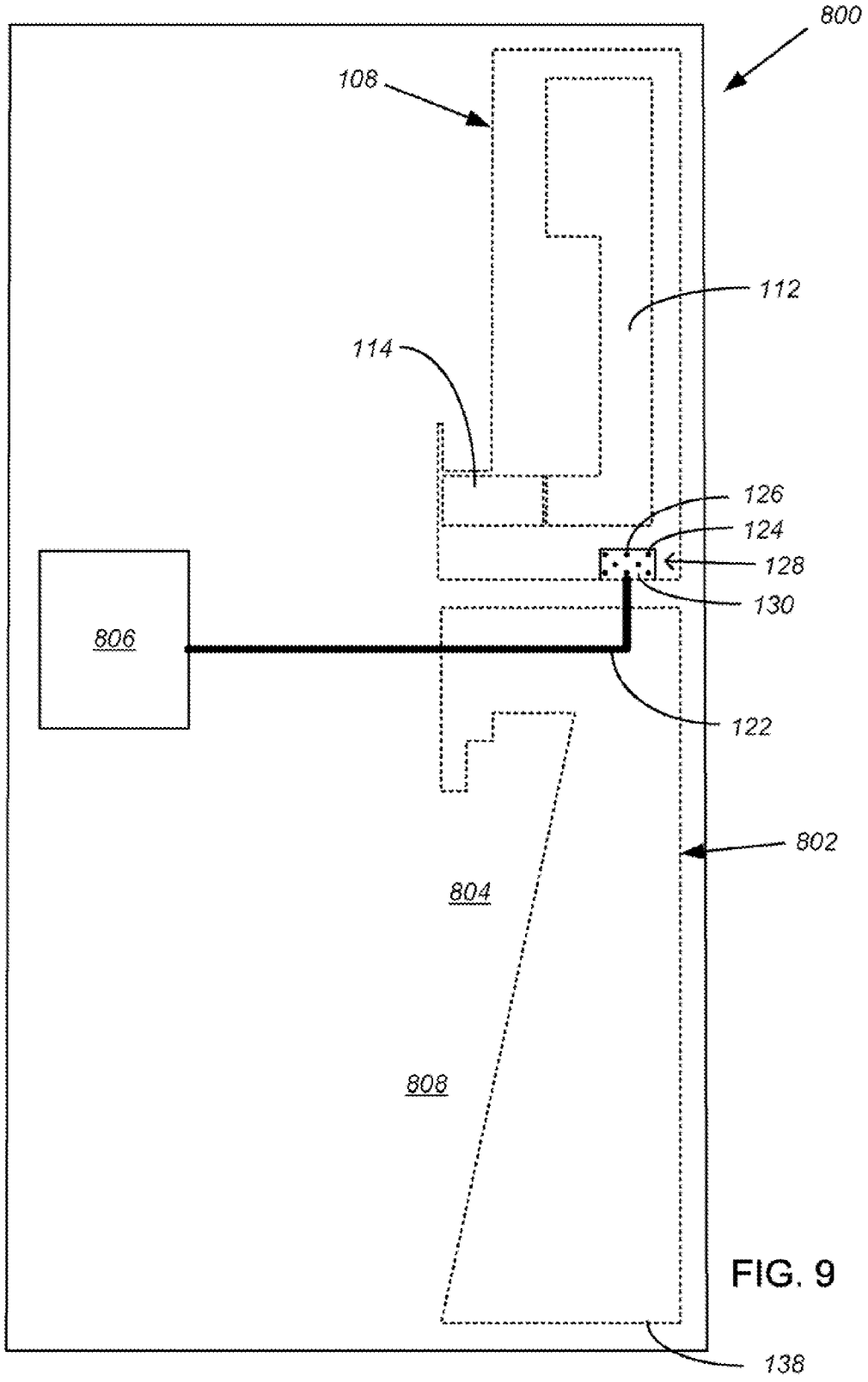

FIGS. 8 & 9 illustrate a variation 800 of the antenna 100 shown in FIGS. 1-3 & 5-7, wherein the holes in the second planar conducting element 802 and dielectric material 804, and the coax cable passing through the holes, have been eliminated. The electrical microstrip feed line 122 is extended, or another feed line (e.g., another microstrip feed line) is joined to it, to electrically connect the electrical microstrip feed line 122 to a radio 806. The second planar conducting element 804 may be connected to a ground potential, such as a system or local ground, that is shared by the radio 806.

In some cases, the radio 806 may be mounted on the same dielectric material 804 as the antenna 800. To avoid the use of additional conductive vias or other electrical connection elements, the radio 806 may be mounted on the second side 808 of the dielectric material 804 (i.e., on the same side of the dielectric material 804 as the electrical microstrip feed line 122). The radio 806 may comprise an integrated circuit.

What is claimed is:

1. An antenna, comprising:

a dielectric material having i) a first side opposite a second side, and ii) a conductive via therein;

a first planar conducting element on the first side of the dielectric material, the first planar conducting element comprising i) a first slot and a second slot therein, wherein the first slot and the second slot are closed slots ii) an electrical connection to the conductive via, wherein the via is formed within the first planar conducting element and iii) dimensions that cause the first planar conducting element to resonate over a first range of frequencies centered about a first center frequency;

a second planar conducting element on the first side of the dielectric material, each of the first and second planar conducting elements positioned adjacent a gap that electrically isolates the first planar conducting element from the second planar conducting element, and the second planar conducting element having dimensions that cause the second planar conducting element to resonate over a second range of frequencies centered about a second center frequency; and an electrical microstrip feed line on the second side of the dielectric material, wherein a conductive pad disposed on the first planar conducting element electrically connects the electrical microstrip feed line to the conductive via formed within the first planar conducting element, and wherein the electrical microstrip feed line extends from the conductive via of the first planar conducting element, to across the gap, to under the second planar conducting element and connecting thereto, wherein a route of the electrical microstrip feed line changes direction under the second planar conducting element, and wherein the second planar conducting element provides a reference plane for the electrical microstrip feed line.

2. The antenna of claim 1, wherein the dielectric material comprises FR4.

3. The antenna of claim 1, wherein the second planar conducting element has a hole therein, and the dielectric material has a hole therein, the hole in the second planar conducting element and the hole in the dielectric material are aligned.

4. The antenna of claim 3, wherein the hole in the second planar conducting element is larger than the hole in the dielectric material, wherein the first side of the dielectric material adjacent the hole in the dielectric material is exposed.

5. The antenna of claim 3, further comprising a coax cable having a center conductor, a conductive sheath, and a dielectric separating the center conductor from the conductive sheath, wherein the center conductor extends through the hole in the second planar conducting element and the hole in the dielectric material, wherein the center conductor is electrically connected to the electrical microstrip feed line, and wherein the conductive sheath is electrically connected to the second planar conducting element.

6. The antenna of claim 5, wherein:

the antenna has a length extending from the first planar conducting element to the second planar conducting element, the length crossing the gap;

the antenna has a width perpendicular to the length; and the coax cable follows a route that is parallel to the width of the antenna, the coax cable being urged along the route by the electrical connection of the conductive sheath to the second planar conducting element.

7. The antenna of claim 1, wherein:

the antenna has a length extending from the first planar conducting element to the second planar conducting element, the length crossing the gap;

the antenna has a width perpendicular to the length; and the route of the electrical microstrip feed line crosses the gap parallel to said length, then changes direction and extends parallel to said width.

8. The antenna of claim 1, wherein the first planar conducting element and the second planar conducting element are metallic.

9. The antenna of claim 1, wherein at least one of the first slot or the second slot has a slot perimeter with more than four straight edges.

10. The antenna of claim 1, wherein the second planar conducting element has a perimeter having more than four edges.

11. The antenna of claim 1, wherein a portion of the second planar conducting element has a horn shape.

12. The antenna of claim 1, wherein:

the dielectric material has a plurality of conductive vias therein, of which the conductive via is one, and wherein each conductive via of the plurality of conductive vias is positioned proximate to others of the conductive vias at a connection site; and each of the electrical microstrip feed line and the first planar conducting element is electrically connected to each via of the plurality of conductive vias.

13. The antenna of claim 1, further comprising a radio on the dielectric material, wherein the electrical microstrip feed line is electrically connected to the radio, and wherein the radio is configured to energize the first and the second planar conducting elements.

14. The antenna of claim 13, wherein the radio is on the second side of the dielectric material.

15. The antenna of claim 13, wherein the radio comprises an integrated circuit.

16. The antenna of claim 1, wherein the first range of frequencies and the second range of frequencies do not overlap.

17. The antenna of claim 1, wherein the first range of frequencies and the second range of frequencies overlap.

18. The antenna of claim 1, wherein the first slot is axially asymmetric.

19. The antenna of claim 1, wherein one end of the second planar conducting element is stair shaped.

20. The antenna of claim 1, wherein the antenna is a multi-band antenna with omni-directional azimuth.

21. An antenna, comprising:

a dielectric material having i) a first side opposite a second side, and ii) a conductive via therein;

a first planar conducting element on the first side of the dielectric material, the first planar conducting element having i) a first slot and a second slot therein, wherein the first and the second slots are closed slots and ii) an electrical connection to the conductive via, wherein the conductive via is formed within the first planar conducting element;

a second planar conducting element on the first side of the dielectric material, each of the first and second planar conducting elements positioned adjacent a gap that electrically isolates the first planar conducting element from the second planar conducting element, wherein the antenna is a multi-band antenna with omni-directional azimuth; and an electrical microstrip feed line on the second side of the dielectric material, wherein a conductive pad disposed on the first planar conducting element electrically connects the electrical microstrip feed line to the conductive via formed within the first planar conducting element, and wherein the electrical microstrip feed line extends from the conductive via of the first planar conducting element, to across the gap, to under the second planar conducting element and connecting thereto, wherein a route of the electrical microstrip feed line changes direction under the second planar conducting element, and wherein the second planar conducting element provides a reference plane for the electrical microstrip feed line.

22. The antenna of claim 21, further comprising a radio on the dielectric material, wherein the electrical microstrip feed line is electrically connected to the radio.

23. The antenna of claim 21, wherein the first slot is axially asymmetric.

* * * * *